United States Patent [19]

Forman et al.

[11] 4,178,722

[45] Dec. 18, 1979

[54] GRINDING AND POLISHING TOOL

[75] Inventors: Donald B. Forman; Gary M. Holma, both of San Diego, Calif.

[73] Assignee: The United States of America as represented by the Secretary of the Navy, Washington, D.C.

[21] Appl. No.: 870,387

[22] Filed: Jan. 18, 1978

[51] Int. Cl.[2] ..... B24B 23/00

[52] U.S. Cl. ..... 51/170 T; 51/219 R

[58] Field of Search ..... 51/170 T, 219 R, 210, 51/208, 205 WG, 216 H, 238 R, 241 G, 263

[56] References Cited

U.S. PATENT DOCUMENTS

| | | | |
|---|---|---|---|
| 2,184,508 | 12/1939 | Major | 51/170 T |
| 2,764,856 | 10/1956 | Steen et al. | 51/263 |
| 3,299,579 | 1/1967 | Jacobson | 51/206 R |
| 3,885,355 | 5/1975 | Kakimoto | 51/134.5 F |
| 3,975,865 | 8/1976 | Lewis | 51/170 T |

FOREIGN PATENT DOCUMENTS

| | | | |
|---|---|---|---|
| 479651 | 2/1938 | United Kingdom | 51/219 R |

*Primary Examiner*—Othell M. Simpson
*Assistant Examiner*—Roscoe V. Parker, Sr.
*Attorney, Agent, or Firm*—R. S. Sciascia; G. J. Rubens

[57] ABSTRACT

A grinding and polishing tool is designed to finish the ends of fiber optic cable terminals preparatory to installation or maintenance, the tool being portable to enable the work to be performed in a field environment, and is air driven to eliminate any electrical arcing in hazardous areas, such as around aircraft and vessels.

9 Claims, 4 Drawing Figures

GRINDING AND POLISHING TOOL

BACKGROUND OF THE INVENTION

This invention relates to tools, and more particularly to a grinding and polishing tool capable of obtaining an improved finish of the ends of fiber optic cable terminals prior to coupling.

Various types of grinding and polishing tools have been developed for a multitude of different workpieces. In the relatively new field of fiber optic cable transmission systems there is a need to provide a polishing tool for finishing the ends of fiber optic terminals used in various types of connections.

U.S. Pat. No. 3,975,865 discloses a hand-held fiber optic grinding and polishing tool specifically designed for fiber optic terminals. The present invention represents an improvement over this patented construction in that an air driven power source is employed in the tool instead of an electric motor for eliminating any arcing that may otherwise create a dangerous condition in an explosive environment, such as around jet aircraft. In addition, a smoother light emitting surface is achieved by the present tool in that the angular orientation between the end of the workpiece and the engaging abrasive surface is constantly changed during the grinding and polishing operation, and the overlapping abrasive cuts produce a smoother and flatter workpiece surface. It is obvious that smoother and flatter light emitting surfaces of fiber optic cables provide for more efficient light transmission because of the reduction of light loss across the optical junction.

SUMMARY OF THE INVENTION

A hand-held grinding and polishing tool is provided to be portable for use in field installations, such as aboard aircraft and vessels. The tool is air driven to eliminate the danger of electrical arcing that can cause explosions at such type installations. In one embodiment of the invention, a plurality of concentric abrasive surfaces having different degrees of roughness are mounted on a disc rotatably driven by the air motor. The disc is enclosed within a housing having on its front face a plurality of concentric guide slots, one slot being located adjacent to and accessible to a corresponding abrasive surface. The end of the fiber optic cable terminal to be finished is movably supported within each slot by a pivotal arm which holds the terminal perpendicular to the abrasive surfaces. The length of the arm is pivotally adjustable to support the terminal in each of the respective guide slots.

A significant feature of the invention resides in finishing the fiber optic cable end so that the abrasive marks on the workpiece surface are arcuate, and also crisscross, which results in a flatter and smoother light emitting surface. The objective finish is a maximum roughness of 10 micro-inches and a maximum waviness of 0.001"over entire end surface. This result has been achieved by having both a movable abrasive surface and a workpiece surface movable transversely across the direction of movement of the abrasive surface, at least one of said surfaces having a rotational movement about an axis other than its own axis. In a second embodiment of the invention, the abrasive surface can be made movable rectilinearly, such as on an endless belt, and the workpiece pivotally mounted to swing across the abrasive surface in a direction transverse to the direction of movement of the abrasive surface. In a second embodiment of the invention, the abrasive surface can be made movable rectilinearly, such as on an endless belt, and the workpiece pivotally mounted to swing across the abrasive surface in a direction transverse to the direction of movement of the abrasive surface. In a third embodiment of the invention, the abrasive surface is mounted on a rotatable disc and the workpiece is supported to be slidably movable relative to the moving abrasive surface.

DESCRIPTION OF THE PREFERRED EMBODIMENTS

Figure 1:
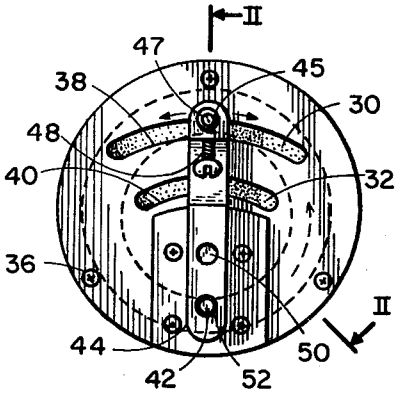
FIG. 1 is a top face view of one embodiment of the novel grinding and polishing tool.
Figure 2:
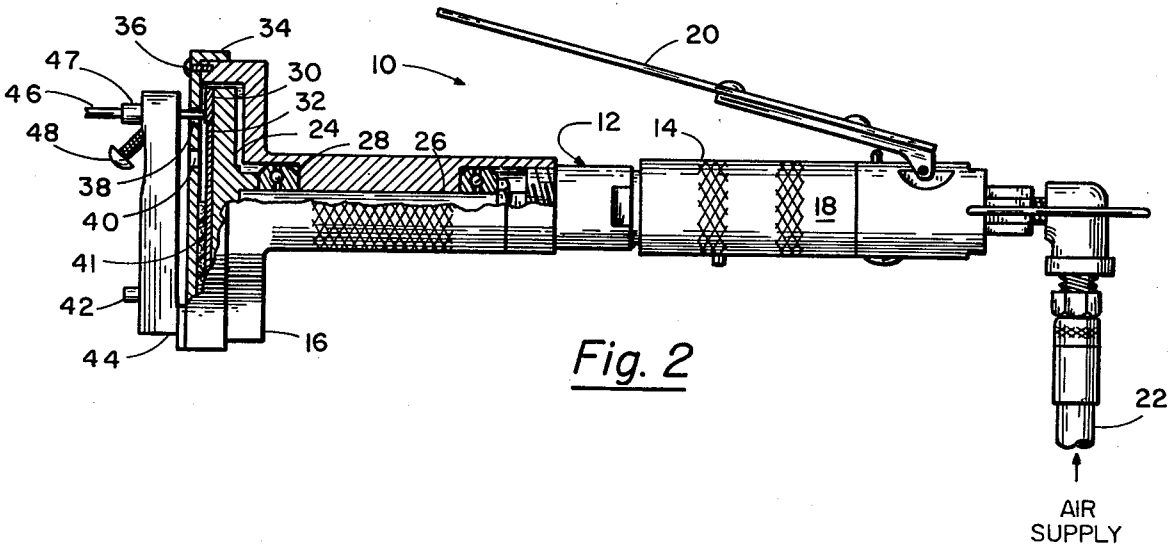
FIG. 2 is a partial longitudinal cross-section taken along line II—II of FIG. 1.

Referring to the drawings where like reference numerals refer to the same parts there is shown in FIGS. 1 and 2 a rotary embodiment of the novel grinding and polishing tool 10 of this invention. The tool comprises a housing 12 which includes a cylindrical handle portion 14 and an enlarged integral disc portion 16. A commercially available air drill motor 18 is housed within handle portion 14 and is controlled by an off/on control lever 20 which extends for a major length of handle portion 14. The air motor normally has a variable operating speed from 200 to 1000 rpm. Air motor 18 is powered from a suitable air source, not illustrated, through hose 22. An air motor is utilized because electric arcing tools are not permitted in hazardous explosive areas, such as around aircraft. In addition, the air driven tool is smaller and lighter in weight making it more suitable for hand-held tools, especially when used in confined installations.

Air motor 18 drives an abrasive wheel support 24 through drive shaft 26 suitably supported in the housing by a pair of thrust bearings 28. Mounted on wheel 24 is a plurality of abrasive surfaces, which in the embodiment of FIGS. 1 and 2 are in the configuration of two separate concentric rings 30 and 32. Outer ring 30 contains a coarse abrasive, such as a metal backed lap of 1500 mesh diamond particles which rough grinds the protruding glass fibers down to the metal terminal end. Inner ring 32 is a fine phenolic lap having an aluminum oxide polishing compound mixed with 4000 mesh diamond particles which provides a maximum roughness of 10 micro-inches. The lap on abrasive ring 32 is for fine polishing both ends of the glass fibers and the end of the metal terminal.

A cover 34 is fastened by screws 36 to the periphery of housing disc portion 16, and has formed on its face slots 38 and 40, each slot located adjacent to and extending across a respective abrasive ring. A sponge 41 containing a polishing slurry is positioned between cover 34 and the abrasive rings. In the embodiment of FIGS. 1 and 2, slots 38 and 40 are arcuate in configuration and arranged to be concentric about a common pivot on cover 34 at which is located a pin 42. It is as important that the pivot pin be located at a point other than the rotational axis of abrasive wheel support 24 for reasons which will be described later.

An arm-shaped holder 44 has a drilled opening 45 at a free end to removably support a fiber optical cable 46 and its terminal during the machining operation, the terminal being secured therein by a screw 48. Holder 44 supports the terminal in a perpendicular relationship to the abrasive surfaces. The other end of holder 44 has a plurality of drilled openings 50 and 52 adapted to receive pivot pin 42 for varying the radius of arm, depending on which abrasive ring is being used.

It is an important feature of the invention that both the abrasive surfaces and the terminal holder are movable, and that one have a pivotal or rotational movement. In the modification of FIGS. 1 and 2 where both holder and the abrasive surfaces are rotatable, it is important that the rotational axis of terminal holder 44 be located at an axis other than the rotational axis of the abrasive surface. By such an arrangement, it has been found that the final polished fiber optic surface is both flatter and smoother. As previously stated the maximum roughness should be about 10 micro-inches, and a maximum waviness of 0.001 inches over the entire end surface. This result is achieved because as the workpiece is traversed over the moving abrasive surfaces it also rotates as it contacts a different area of the abrasive surface. The rotation of the workpiece around an axis different than the axis of the abrasive surfaces causes the abrasive scratches on the end surface of the terminal to successively cross each other, and this overlapping results in a flatter and smoother surface on the workpiece which is so important in a light emitting fiber optic cable. It should be noted that this novel result would not be achieved if pivot pin 42 of holder 44 was located at the rotational axis of abrasive surface wheel 24.

In the operation of the tool of FIGS. 1 and 2, holder 44 is adjusted in length by engaging pin 42 with opening 52 so that holder 44 will fit into slot 38 adjacent coarse abrasive ring 30. Fiber optic cable 46 and its assembled terminal 47 is securely clamped within holder opening 45 by screw 48 to extend perpendicular to the surface of abrasive ring 30. Grasping housing 12 and handle 20 with one hand of the operator will start the air motor, and the terminal is oscillated by the other hand of the operator through corresponding cover slot 38 during the rough grinding operation. When the rough grinding operation is completed, holder 44 is then adjusted in length so that holder opening 50 is aligned with pin 42 which positions the terminal in slot 40 to complete the final polishing operation.

Figure 3:
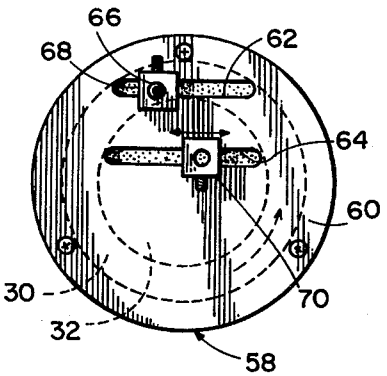
FIG. 3 is a top view of a second embodiment of the tool.

FIG. 3 illustrates a modified embodiment of the rotary tool 58 of FIGS. 1 and 2 in that the housing cover 60 is formed with straight guide slots 62 and 64, for the coarse outer ring 30 and fine inner ring 32, respectively. It may be said that slots 62 and 64 have an infinite radius which, as previously described, must be offset from the rotational axis of wheel 24. A fiber optic cable terminal 66 to be finished is vertically secured in a holder 68 and 70, slidably mounted in each of the corresponding cover slots. Terminal 66 is reciprocated back and forth in each slot as the abrasive surfaces are rotated, in a manner similarly described with reference to FIGS. 1 and 2.

Figure 4:
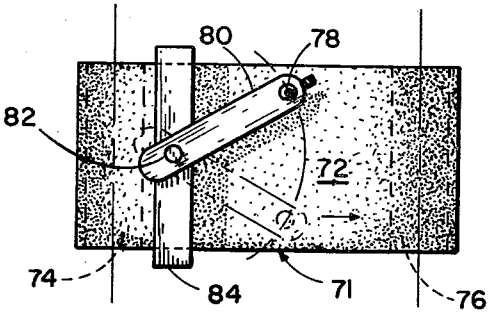
FIG. 4 is a top view of a third embodiment of the tool.

A third embodiment of the novel invention tool 71 is illustrated in FIG. 4, where an abrasive surface 72 is in the form of a rectilinearly moving belt suitably mounted on rollers 74 and 76. A fiber optic terminal 78 is supported on a free end of an arm 80 pivoted at pin 82 on a support 84, which extends over and is spaced from the abrasive belt 72.

The novel grinding and polishing tool of this invention is portable, light weight, and compact so as to be readily transportable to an installation and used in confined quarters. The use of air power enables the tool to be used safely in an explosive environment. The quality of the finished workpiece surface is improved by designing the abrasive surfaces and the workpiece surface to be both relatively movable, and one of which surfaces being rotatable at an axis other than at a rotatable axis of the other surface. As a consequence the workpiece end surface is made flatter and smoother because the abrasive markings on the workpiece surfaces constantly overlap as the workpiece is being rotated about an axis other than that of the moving abrasive surfaces.

Obviously many modifications and variations of the present invention are possible in the light of the above teachings. It is therefore to be understood that within the scope of the appended claims the invention may be practiced otherwise than as specifically described.

We claim

1. A grinding tool comprising:

a disc member having at least one flat circular abrasive band;

means for rotatably driving said disc member about an axis;

means for supporting an elongate workpiece having a longitudinal axis in a perpendicular relationship with respect to said abrasive surface and in oscillatory movement with respect to said abrasive surface in an arc having a radius greater than the radius of said disc member, said axis of the disc member lying between the axis of the supporting means and the workpiece;

means for locking the workpiece in the supporting means;

whereby during the grinding operation the abrasive scratch marks on said workpiece surface overlap to improve the smoothness and flatness of the workpiece surface and said flat workpiece surface extends perpendicular to said workpiece axis.

2. The tool of claim 1 wherein the disc member is provided with at least two concentric abrasive bands having different abrasive characteristics; and the means of supporting the workpiece is adjustable to position the workpiece with respect to either abrasive band.

3. The tool of claim 2 wherein said disc member is provided with a housing, said supporting means comprising an arm having one end adjustably pivoted on the housing in positions to correspond with the abrasive bands, and the other end supporting said workpiece.

4. The tool of claim 3 wherein guide means are provided on the housing coacting with the arm for limiting the oscillatory movement of the workpiece with respect to each abrasive band.

5. The tool of claim 2 wherein the width of each abrasive band is determined by the difference between the radius of rotation of the workpiece support and the radius of rotation of the disc member.

6. The tool of claim 1 wherein said disc member is provided with a housing having a receptacle for dispensing a polishing slurry to the abrasive surface.

7. The tool of claim 6 wherein a sponge-like material is supported within the housing receptacle to be in contact with the abrasive surface for dispensing the slurry.

8. A portable, hand-held grinding tool comprising:

a housing having a tubular handle portion;

an air driven motor supported within the tubular portion; a disc member rotatable about an axis and having at least two flat concentric bands of abrasive surfaces and supported within the housing adjacent the handle portion, said disc member being driven by said motor;

said disc member lying in a plane perpendicular to the longitudinal axis of the handle portion so that the disc member can be supported in a substantially horizontal plane when the handle is supported by the operator's hand in vertical position;

means for supporting and oscillating a workpiece about an axis with respect to each abrasive band; the axis of the disc member lying between the axes of the supporting means and the workpiece;

said supporting means being adjustable to position the surface of the workpiece adjacent each abrasive band;

whereby during the grinding operation the abrasive scratch marks on said workpiece overlap to improve the smoothness of the workpiece surface.

9. The tool of claim 8 wherein said housing contains a sponge-like means for dispensing a polishing slurry to the abrasive surface.

* * * * *